US009756709B2

(12) United States Patent
Raza et al.

(10) Patent No.: US 9,756,709 B2
(45) Date of Patent: Sep. 5, 2017

(54) WIRELESSLY CONTROLLED LIGHTING DEVICE

(71) Applicant: Hubbell Incorporated, Shelton, CT (US)

(72) Inventors: Syed A. Raza, Rancho Palos Verdes, CA (US); Dean Dal Ponte, Glendale, CA (US); Shaun Robert Toms, Fontana, CA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/136,178

(22) Filed: Apr. 22, 2016

(65) Prior Publication Data

US 2016/0323978 A1 Nov. 3, 2016

Related U.S. Application Data

(60) Provisional application No. 62/155,839, filed on May 1, 2015.

(51) Int. Cl.
*H05B 37/02* (2006.01)
*H05B 33/08* (2006.01)
(Continued)

(52) U.S. Cl.
CPC ..... *H05B 37/0272* (2013.01); *F21V 15/02* (2013.01); *F21V 19/02* (2013.01);
(Continued)

(58) Field of Classification Search
CPC ..... H05B 37/0272; H05B 33/0815; H05B 33/0827; H05B 33/0845; F21V 15/02; F21V 19/02; F21V 14/02; F21V 23/04; F21V 23/045; F21Y 2105/18; F21Y 2113/13; F21Y 2115/10; F21S 8/022
(Continued)

(56) References Cited

U.S. PATENT DOCUMENTS 6,380,865 B1 4/2002 Pederson
9,374,854 B2 * 6/2016 Quilici ..... H05B 33/08
(Continued)

OTHER PUBLICATIONS

PCT/US2016/028878 International Search Report and Written Opinion dated Jul. 25, 2016 (13 pages).
(Continued)

*Primary Examiner* — Daniel D Chang
(74) *Attorney, Agent, or Firm* — Michael Best & Friedrich LLP

(57) ABSTRACT

A lighting device includes a housing that defines an opening, and light board moveably positioned in the housing adjacent the opening. The light board has a plurality of light modules operable to provide a light output through the opening. The lighting device further includes a motor operatively connected to the light board to move the light board. The lighting device further includes a controller in electrical communication with the motor and the light board. The controller is operable to receive signals from a communication device. The controller is further operable to control the motor to orient the light board. The controller is further operable to control an intensity and a color of the light output of the light modules.

24 Claims, 9 Drawing Sheets

(51) Int. Cl.

| | |
|---|---|
| ***F21V 21/15*** | (2006.01) |
| ***F21V 14/02*** | (2006.01) |
| ***F21V 15/02*** | (2006.01) |
| ***F21V 19/02*** | (2006.01) |
| *F21S 8/02* | (2006.01) |
| *F21V 23/04* | (2006.01) |
| *F21Y 115/10* | (2016.01) |
| *F21Y 113/13* | (2016.01) |
| *F21Y 105/18* | (2016.01) |

(52) U.S. Cl.
CPC ..... *H05B 33/0815* (2013.01); *H05B 33/0827* (2013.01); *H05B 33/0845* (2013.01); *F21S 8/022* (2013.01); *F21V 14/02* (2013.01); *F21V 23/04* (2013.01); *F21V 23/045* (2013.01); *F21Y 2105/18* (2016.08); *F21Y 2113/13* (2016.08); *F21Y 2115/10* (2016.08)

(58) Field of Classification Search
USPC ..... 315/291
See application file for complete search history.

(56) References Cited

U.S. PATENT DOCUMENTS

| | | | | |
|---|---|---|---|---|
| 2010/0308755 | A1 | 12/2010 | Van Liempd et al. | |
| 2013/0271004 | A1 | 10/2013 | Min et al. | |
| 2014/0043791 | A1 | 2/2014 | Diederiks et al. | |
| 2014/0301071 | A1* | 10/2014 | Jorgensen | F21V 14/06 362/231 |
| 2015/0345776 | A1* | 12/2015 | Brandon, Jr. | A47G 23/0208 362/101 |
| 2016/0215961 | A1* | 7/2016 | Kjeldsen | F21V 14/06 |
| 2016/0245490 | A1* | 8/2016 | Jurik | F21V 21/30 |

OTHER PUBLICATIONS

"LightVault 8", Hubbell Lighting brochure, 2013, 20 pages, Kim Lighting, City of Industry, California.

* cited by examiner

WIRELESSLY CONTROLLED LIGHTING DEVICE

CROSS-REFERENCE TO RELATED APPLICATION

This application claims the benefit of prior-filed, U.S. Provisional Patent Application No. 62/155,839, filed May 1, 2015, the entire contents of which are incorporated by reference herein.

BACKGROUND

The present application relates to lighting devices, and more specifically to wirelessly controllable lighting devices.

Recessed in-grade light fixtures are a type of light fixture that is typically installed below ground in cement or dirt. The in-grade light fixture is utilized to provide light output to a wall or structure, or alternatively along a path. It is often desirable to change a characteristic of the light output depending on different situations or conditions.

SUMMARY

In one aspect, a lighting device includes a housing defining an opening, and a light board moveably positioned in the housing adjacent the opening and having a plurality of light modules operable to provide a light output through the opening. The lighting device further includes a motor operatively connected to the light board to move the light board, and a controller in electrical communication with the motor and the light board. The controller is operable to receive a signal from a communication device, and the controller is operable to control the motor to orient the light board, an intensity of the light output of the light modules, and a color of the light output of the light modules.

In another aspect, a lighting device includes a housing defining an opening, a light board positioned in the housing adjacent the opening and having a light module operable to provide a light output through the opening. The lighting device further includes a controller in electrical communication with the light board. The controller is operable to receive a signal from a communication device and control a color of the light output of the light module.

In yet another aspect, a method includes providing a lighting device including a housing and a light board having a light module operable to provide a light output. The method further includes sending a signal from a communication device to a controller in electrical communication with the light board. The method further includes changing a color of the light output with the controller based on the signal received from the communication device.

Other aspects of the application will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Also, it is to be understood that the phraseology and terminology used herein is for the purpose of description and should not be regarded as limiting. As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
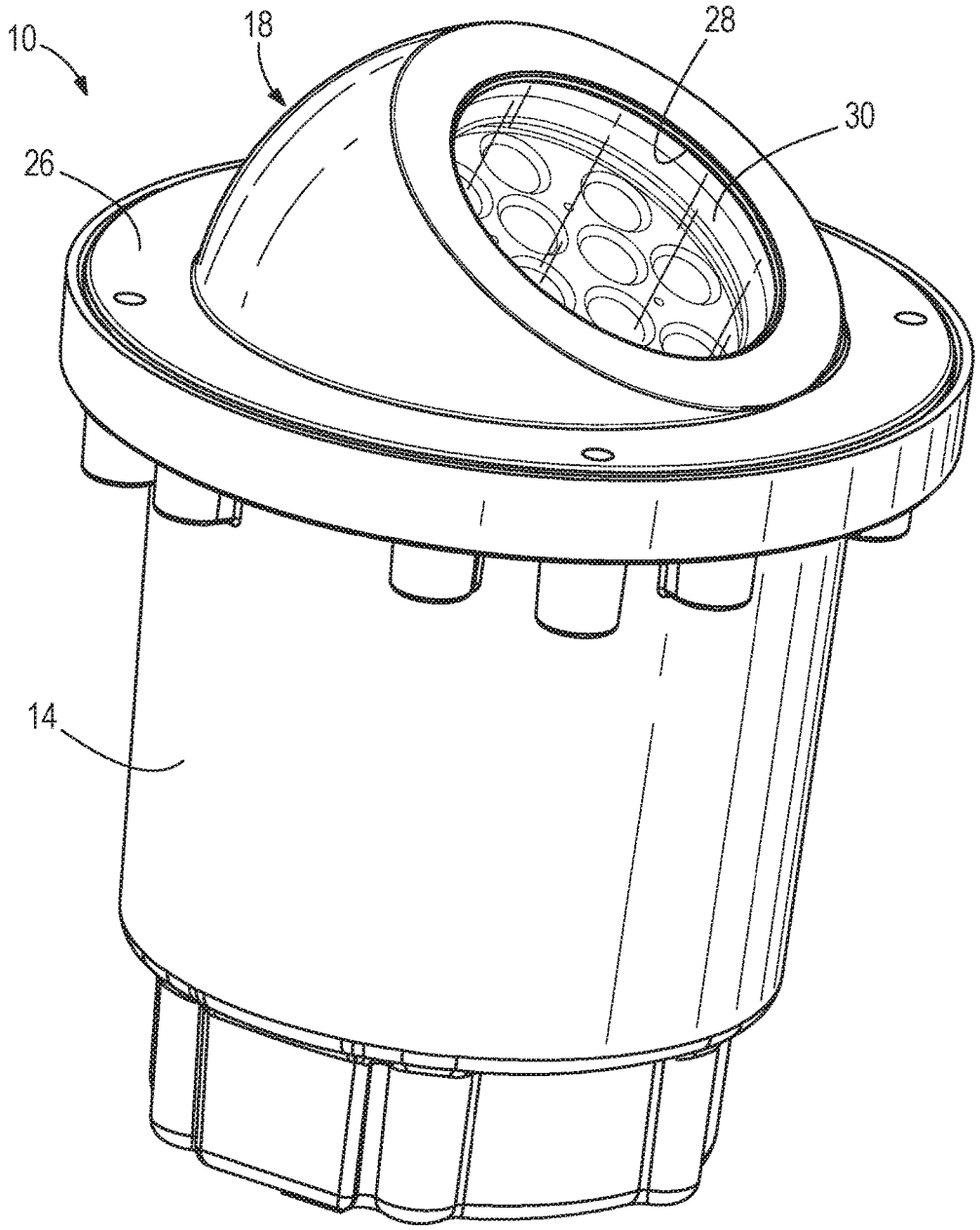
FIG. 1 is a perspective view of a lighting device.

FIG. 1 illustrates a controllable lighting device or light fixture 10. In particular, an in-grade lighting device is shown that is controllable via a short range transceiver configured to receive short range wireless signals, or via a wired communication module.

Figure 2:
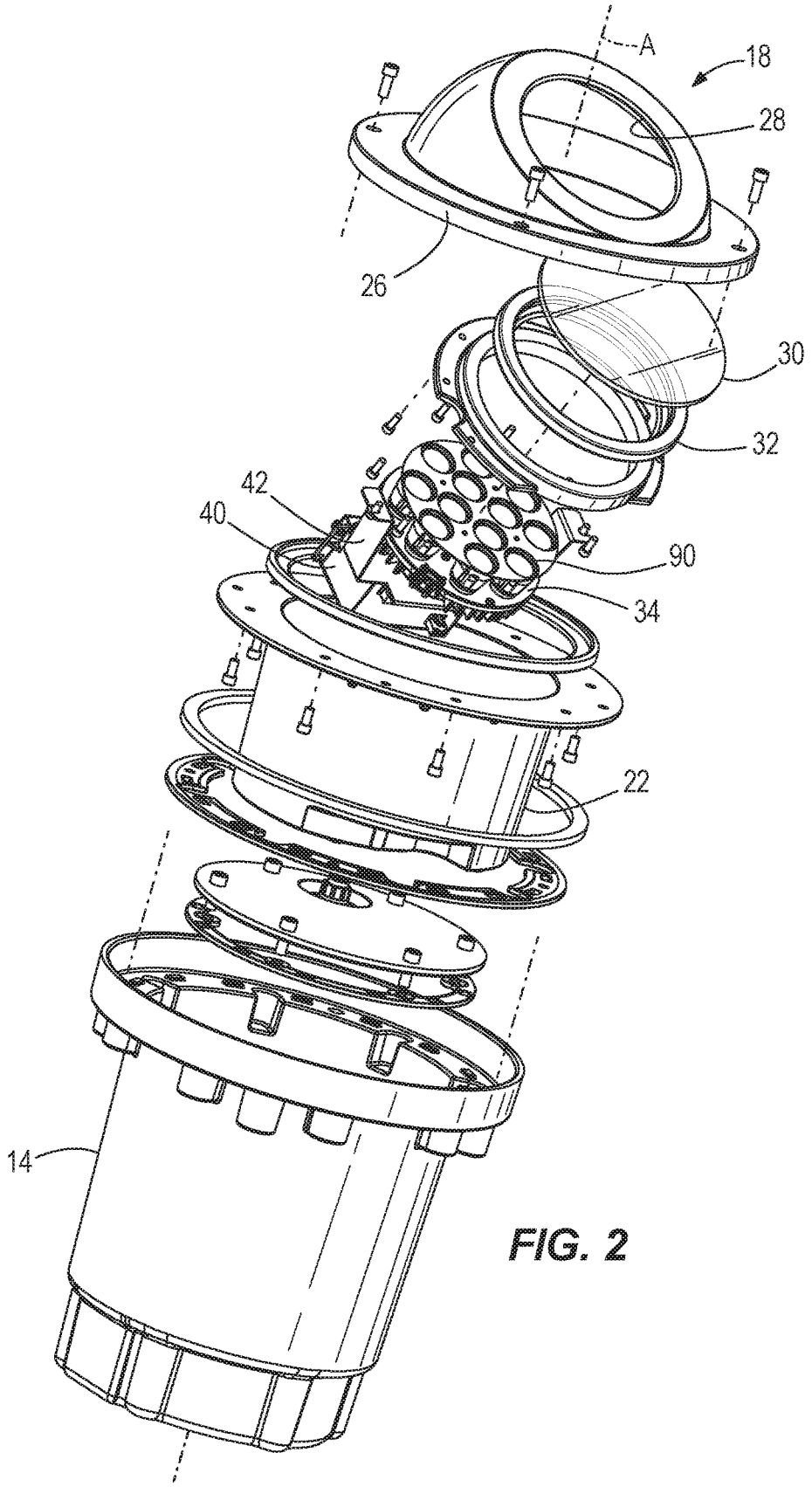
FIG. 2 is an exploded perspective view of the lighting device of FIG. 1.

As best illustrated in FIGS. 1 and 2, the light fixture 10 includes an outer housing 14 having a longitudinal axis A, and a component module casing 18. The component module casing 18 includes a bottom portion 22 and a cover portion 26 secured to the bottom portion 22, e.g., by fasteners. In addition, the component module casing 18 is secured within the outer housing 14, e.g., by fasteners. The cover portion 26 has a partial spherical shape and includes a flat portion forming a window or opening 28.

A lens 30 is contained within the component module casing 18 and is arranged to overlay the opening 28 within the cover portion 26. The lens 30 can be made from one or more materials, including clear tempered glass, and is sealed with a gasket 32, as shown in FIG. 2. The lens 30 may be a slip-resistant lens with a textured surface to prevent slipping on the lens 30. In some embodiments, a hex cell louver or a prismatic lens (not shown) may be positioned within the component module casing behind the lens 30 to create different output light characteristics. In some embodiments, the lens 30 may be a diffuser lens to spread or scatter (i.e., "soften") the output light.

Figure 3:
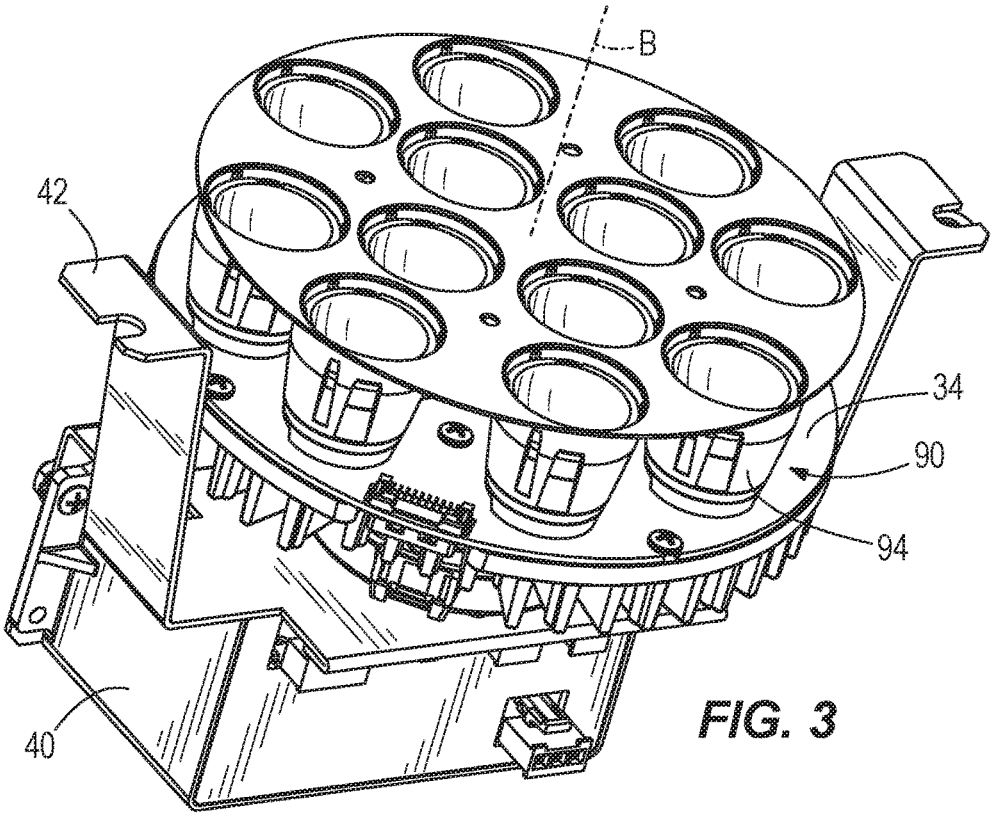
FIG. 3 is a perspective view of a light board and a controller.
Figure 4:
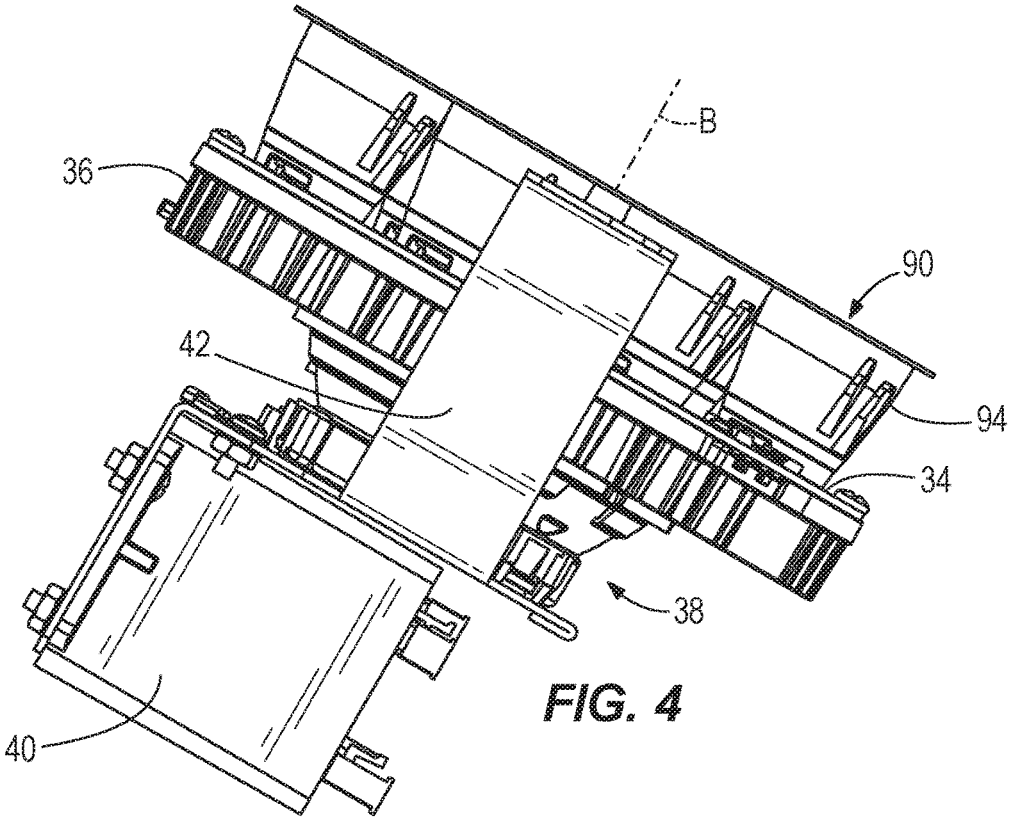
FIG. 4 is a side view of a gimbal motor, the light board, and the heat sink of the lighting device of FIG. 1.
Figure 5:
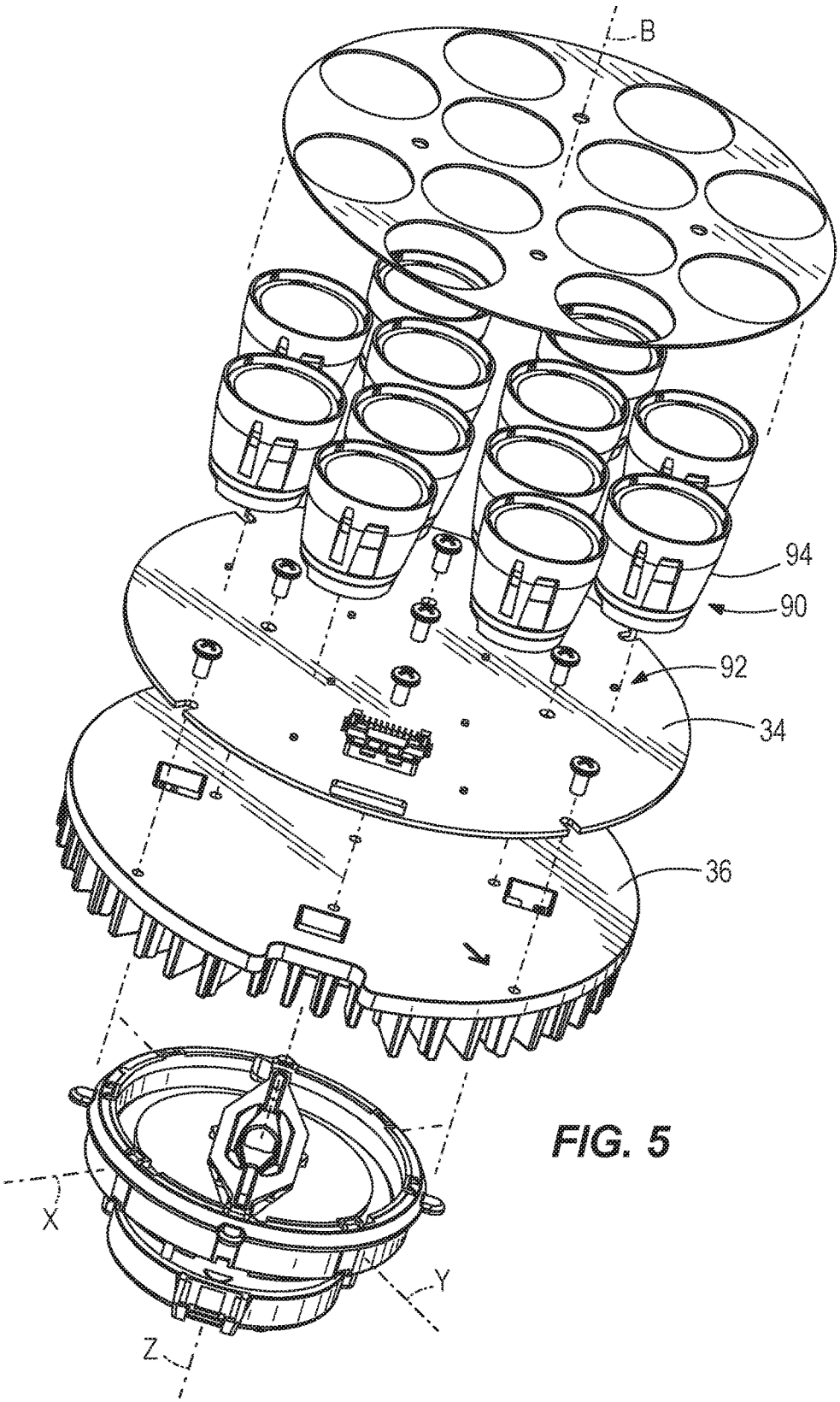
FIG. 5 is an exploded view of the light board and the gimbal motor of the lighting device of FIG. 1.

With reference to FIGS. 3-5, the light fixture 10 further includes a light board 34, a heat sink 36, a gimbal motor 38, and a splice box 40 supporting a controller 50 (FIG. 6) for controlling the light board 34 and the gimbal motor 38. The light board 34, the heat sink 36, the gimbal motor 38, and the controller 50 are contained within the component module casing 18. The heat sink 36 is coupled to the light board 34 to dissipate heat. The gimbal motor 38 is fixed to the splice box 40. The splice box 40, the gimbal motor 38, the heat sink 36, and the light board 34 are supported by a bracket 42 that is coupled to the cover portion 26 by fasteners within the interior of the component module casing 18. The bracket 42 supports the light board 34 adjacent the opening 28 and the lens 30, such that a light output from the light board 34 is directed through the lens 30 and out the opening 28.

In the illustrated embodiment, the outer housing 14 is a pour box rough-in housing for installing the light fixture 10 below grade (i.e., below ground) such that only the lens 30 and the cover portion 26 are visible. The outer housing 14 can be formed of high temperature resistant thermal plastic. The outer housing 14 also includes multiple apertures (not shown) on a bottom surface thereof to allow for wiring to be fed to the component module casing 18 to provide power or wired communication to the controller 50, the light board 34, and the motor 38. Similarly, the component module casing 18 has an aperture and/or a connector (not shown) to receive the wiring fed through the outer housing 14 to connect power or wired communication to the controller 50, the light board 34, and/or the motor 38.

Certain embodiments of the light fixture 10 can be installed in concrete. In some embodiments, the light fixture 10 is constructed to withstand substantially large loads, such as those produced by vehicles (weighing for example up to 10,000 lbs). driving over the light fixture 10. The outer housing 14 may be further supported by a rebar cage anchor (not shown) that provides additional structural support when installed in concrete and tied in with paving rebar.

Figure 7:
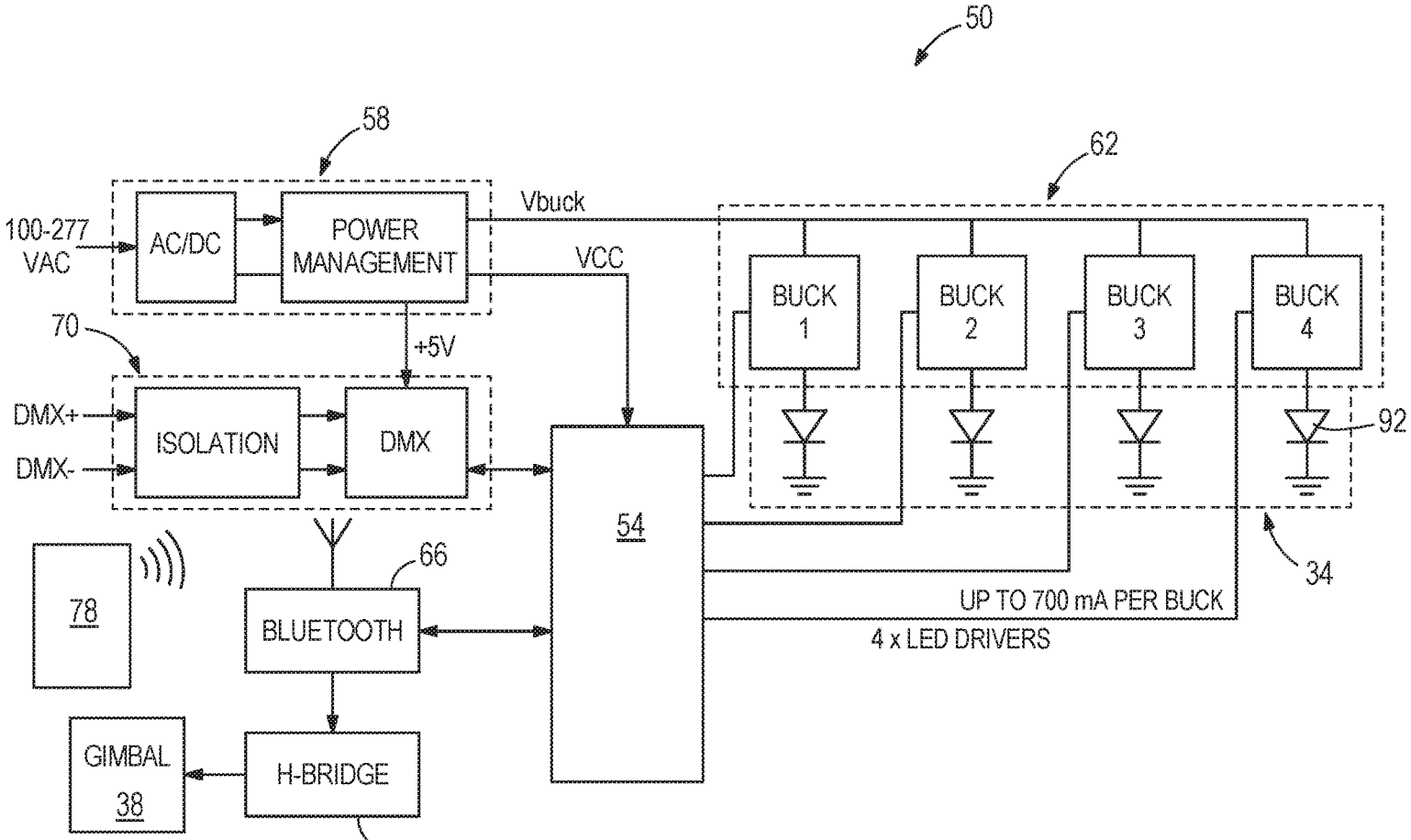
FIG. 7 is an electrical system schematic of the lighting device of FIG. 1.

FIG. 7 illustrates a schematic diagram of the controller 50 of the light fixture 10. The controller 50 includes a processor 54, a power supply 58, a light board driver 62, a wireless communication module 66 (e.g., Bluetooth module), a wired communication module 70, and an H-bridge motor driver 74. The power supply 58 is connected to an AC power source (e.g., mains) and is configured to power the controller 50, the light board 34, and the motor 38. Alternatively, the power supply 58 may receive power from a DC power source such as a battery.

The light fixture 10 (i.e., the gimbal motor 38, and the light board 34) is configured to be controlled by input signals received by either the wireless communication module 66 or the wired communication module 70. The wireless communication module 66 can be configured to communicate via short range wireless signals, for example with a mobile communication device 78 (e.g., a mobile phone, a tablet, a laptop, etc.). The wired communication module 70 is configured to communicate via signals from a digital communication cable connecting the wired communication module 70 with a control console or other wired communication device. The wireless communication module 66 and the wired communication module 70 are both electrically connected with the processor 54, such that the input signals received by the wireless communication module 66 and the wired communication module 70 are sent to the processor 54. The processor 54 is configured to control the output power to the light board 34 via the light board driver 62 based on the input signals received. The gimbal motor 38 is also controlled by the processor 54 based on the input signals received by the wired communication module 70 and the wireless communication module 66.

In some embodiments, the wired communication module 70 is a digital multiplex (DMX) module and the digital communication cable is a DMX cable. DMX modules are configured to receive digital communication signals from the DMX cable connected to a lighting console or other wired communication device. In some configurations cables, such as DMX cables, may connect a plurality of light fixtures 10 together to allow the light fixtures 10 to be controlled simultaneously. DMX is a standard for digital communication networks commonly used for lighting control.

Figure 11:
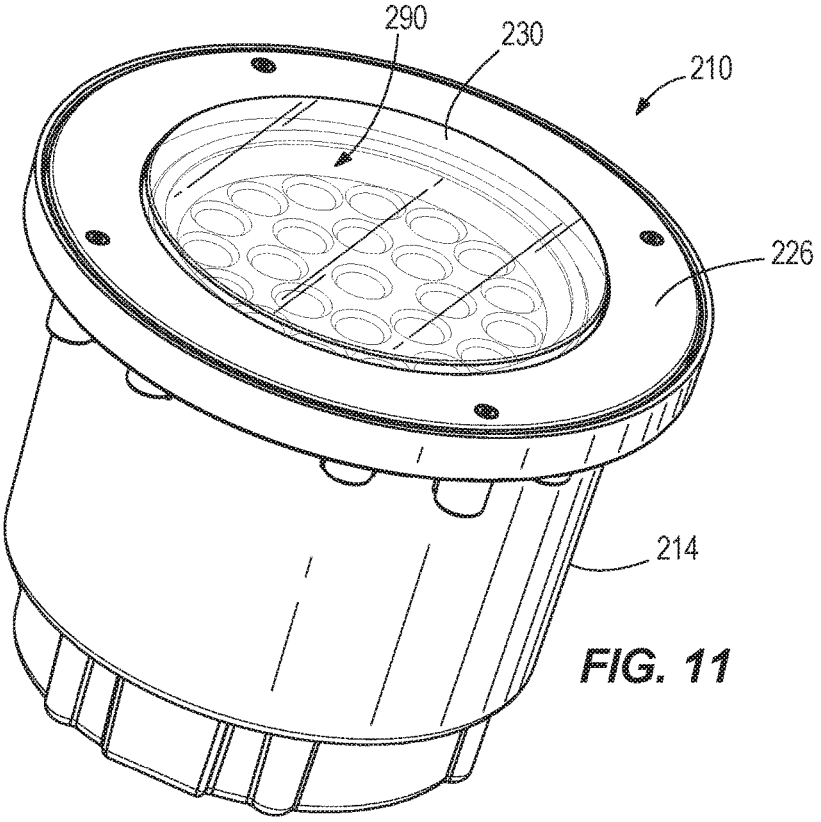
FIG. 11 is a perspective view of a lighting device according to another embodiment.

As best shown in FIGS. 3-5, the light board 34 includes an array of individual light emitting elements or light emitting diode (LED) modules 90, each including an LED 92 or other light emitting element and an optic 94 to concentrate light form the LED 92. The modules 90 provide a light output that is transmitted through the lens 30 along a center axis B of the light board 34. In the illustrated embodiment, the center axis B is perpendicular to the light board 34. In some embodiments (e.g., FIG. 11), a light fixture 210 includes an array having 24 LED modules 290. In other embodiments, the array may include fewer or more LED modules 90. The LEDs 92 of the LED modules 90 are RGBW-type LEDs and can be controlled by the controller 50 so that the LED modules 90 emit any desired color of light in the visible light spectrum. In other words, the LED modules 90 have separately controllable red, green, blue, and white aspects that may be proportionally varied to generate light output of any color. The light board 34 is also controllable to provide a dimming feature, such that light intensity of the LED modules 90 is varied between approximately 0% and 100% of the maximum light intensity.

Figure 12:
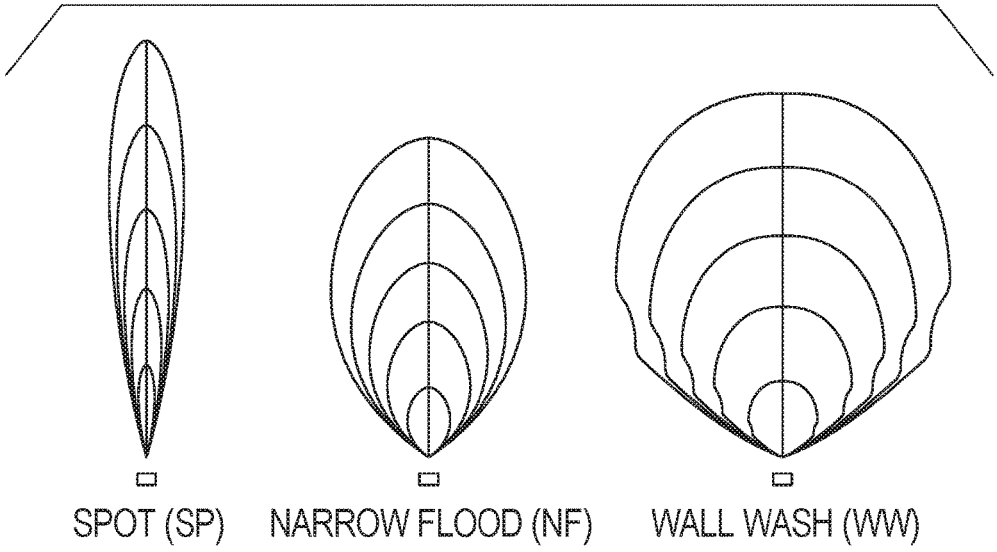
FIG. 12 illustrates various light distribution patterns.

The LED modules 90 can include an optic lens, reflector, or other component to provide a desired light pattern or distribution, including spot (SP), narrow flood (NF), or wall wash (WW) distributions as shown in FIG. 12. In the illustrated embodiment, the optics 94 provide a narrow flood distribution. The LED modules 90 may be configured for other distribution patterns and output light characteristics. For example, the LED modules may be replaced with PicoPrism optic modules that are configured to provide a wall wash distribution (FIG. 12). In some embodiments, the light board 34 may include multiple sets of LED modules 90, each set comprised of a different type of optic module. The multiple sets may then be controlled independently, thus allowing the user to switch between different distribution patterns without replacing the LED modules 90.

As best shown in FIGS. 4-5, the light board 34 is coupled to the gimbal motor 38 to allow adjustable orientation of the light board 34 for aiming the light output. In an exemplary embodiment, the gimbal motor 38 is controllable via the controller 50 to tilt the light board 34 about both a first axis X (FIG. 5) and a second axis Y (FIG. 5) of the motor 38 independently or simultaneously, providing adjustable orientation of the light board 34 for aiming the light output. In the illustrated embodiment, the first and second axes X, Y are perpendicular. The motor 38 further has a third, longitudinal axis Z (FIG. 5) perpendicular to the first and second axes X, Y. In the illustrated embodiment, the motor 38 is oriented so that the third axis Z is parallel with a central axis of the opening 28. In the illustrated embodiment, the light board 34 is arranged such that the center axis B of the light board 34 is parallel with the third axis Z when the motor 38 is in a home position (i.e., no tilt of the light board 34).

Figure 6:
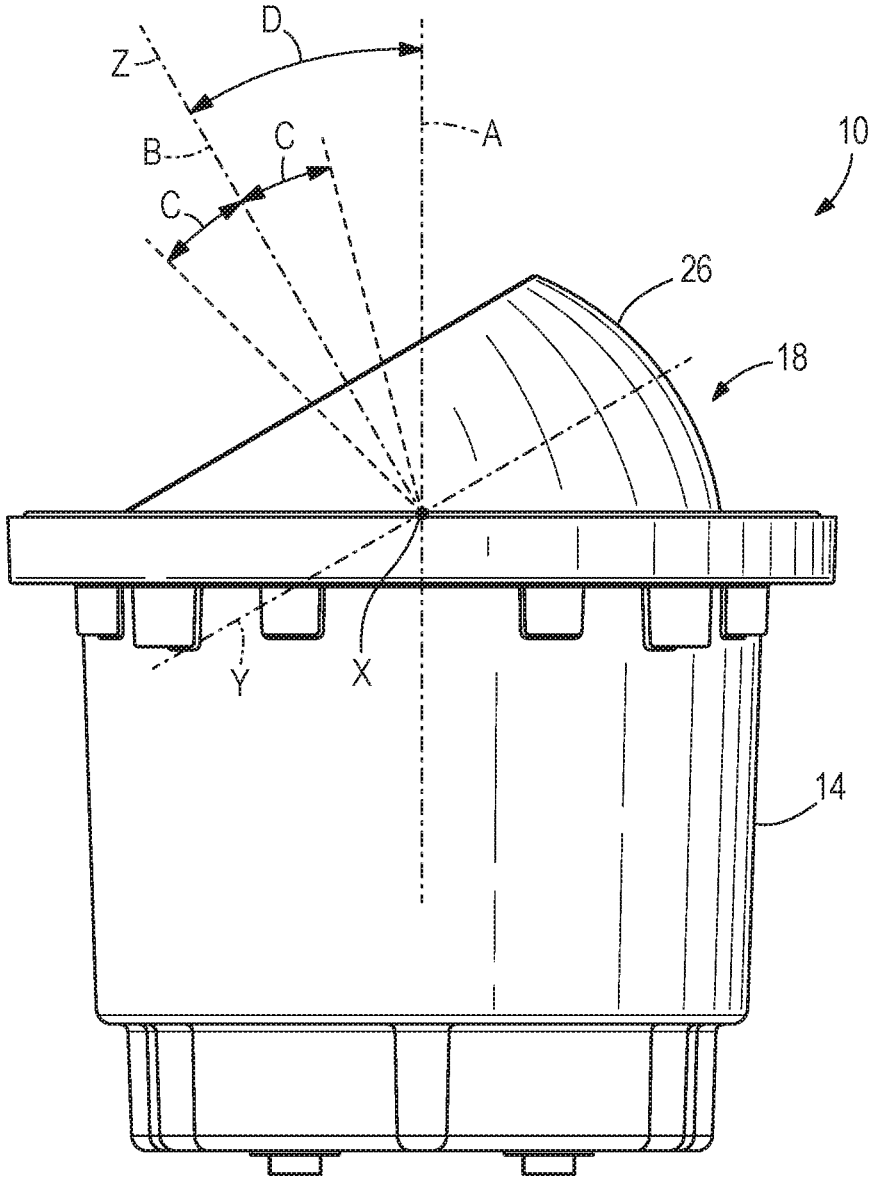
FIG. 6 is a side view of the lighting device of FIG. 1.

As shown in FIG. 6, the gimbal motor 38 can pivot the light board 34 about each of the first and second axes X, Y such that the center axis B of the light board 34 can be tilted by an angle C relative to the third axis Z of the motor 38 (only pivoting about the first axis X is shown in FIG. 6). In the illustrated embodiment, a maximum range for the angle C that the gimbal motor 38 can tilt the light board 34 about each of the axes X, Y is approximately 15 degrees. Although, in some embodiments, a larger or smaller range of motion may be provided. The third axis Z of the gimbal motor 38 is angled by an angle D relative to the longitudinal axis A of the housing 14 of the light fixture 10. In the illustrated embodiment, the angle D formed between the longitudinal axis A of the housing and the third axis Z of the gimbal motor 38 is approximately 30 degrees. In some embodiments, such as those shown in FIGS. 8-11, the center axis B of the light board 34 and the motor 38 may be aligned with the longitudinal axis A of the housing 14, such that the light board 34 is aimed vertically upward along the longitudinal axis A of the housing 14 when in the initial home position. In alternate embodiments, the light board 34 and the motor 38 may be arranged such that the center axis B of the light board 34 is oriented in any direction when in the initial home position.

Although in the illustrated embodiment a gimbal motor 38 is used to move and orient the light board 34 about the first and second axes X, Y, in other embodiments any suitable motor(s) or other method may be used for tilting the light board 34 about either one or both of the axes X, Y, independently or simultaneously.

In some embodiments, the light fixture 10 is controllable through signals sent from the mobile communication device 78 (FIG. 7). The signals are generated by user input via an application provided on the mobile communication device 78. The application has an interface, for example a graphical user interface, that provides for configuration of the controllable characteristics of the light fixture 10 through short wave wireless signals via the mobile communication device 78.

The application includes a feature for controlling intensity of the LED modules 90. For example, the feature may be an intensity slider that is operable to control the intensity of the LED modules 90 between approximately 0% and 100% of the maximum light intensity. The application further includes an aiming feature for controlling the tilt of the light board 34 about both the first and second axes X, Y of the motor 38. For example, the aiming feature may include four directional buttons: a button for each of the two directions an operator may adjust or tilt the light board about the first axis X by discrete increments, and a button for each of the two directions an operator may adjust or tile the light board about the second axis Y by discrete increments. Alternatively, the aiming feature may allow the user to enter in a value of the desired degree of tilt about both the first and second axes X, Y of the motor 38.

The application further includes a color changing feature for controlling the color of the light output of the LED modules 90. In one embodiment, the color changing feature provides a color wheel that the user may use to select a desired color. In addition to (or instead of) the color wheel, the color changing feature may also include selectable preset color options, for example standard red, green, blue, white, and various shades thereof. The application may further provide a color matching feature that allows the user to select a color from an image stored on the mobile communication device 78 or otherwise entered into the application or interface. Alternatively, a color may be determined by averaging the colors of portions of the image, or some of the colors of the image. The color matching feature may allow the user to scan or take a picture using a camera in connection with the mobile communication device 78, average the colors from the image, and then control the LED modules 90 of the light board 34 to emit a same or similarly colored light output. The application further includes an automatic color cycling feature that when activated automatically switches the color of the light output based on an algorithm or a predetermined sequence.

The application is also capable of storing several settings configurations (e.g., at least 10 separate configurations). Each of the settings configurations includes a motor position setting (i.e., tilt positions of the light board 26 about the first and second axes X, Y), a color setting, and an intensity setting. Storing the settings configurations allows for quickly changing between the stored settings configurations via the application on the mobile communication device 78. Each of the stored setting configurations can be named, renamed and grouped within the application. Alternatively, the preset configurations may be stored by the controller 50. In some embodiments, multiple light fixtures 10 may each be given a name and stored within the application. In such embodiments, each of the stored light fixtures 10 may have corresponding stored settings configurations. In some embodiments, the controller 50 stores settings configurations and the name of the light fixture 10.

Additionally, the light fixture 10 stores the current settings on memory of the controller 50 when the light fixture 10 is powered off, such that the settings are automatically restored when the light fixture is powered back on.

The light fixture 10 may alternatively be controlled via the wired communication module 70, as shown in FIG. 7. The wired communication module 70 has six control inputs: four for the intensity of the red, green, blue and white light aspects of the LEDs 92 of the LED modules 90, and two for tilt about the first and second axes X, Y of the gimbal motor 38. Thus, the wired communication module provides for control of the same controllable characteristics of the light fixture 10 as the wireless communication module 66 via the application of the mobile communication device 78. The controller 50 is configured to automatically switch between being controlled via wireless and wired signals depending on whether the wireless communication module 66 is receiving signals from the mobile communication device 78 or the wired communication module 70 is connected via a digital communication cable to receive signals.

Figure 8:
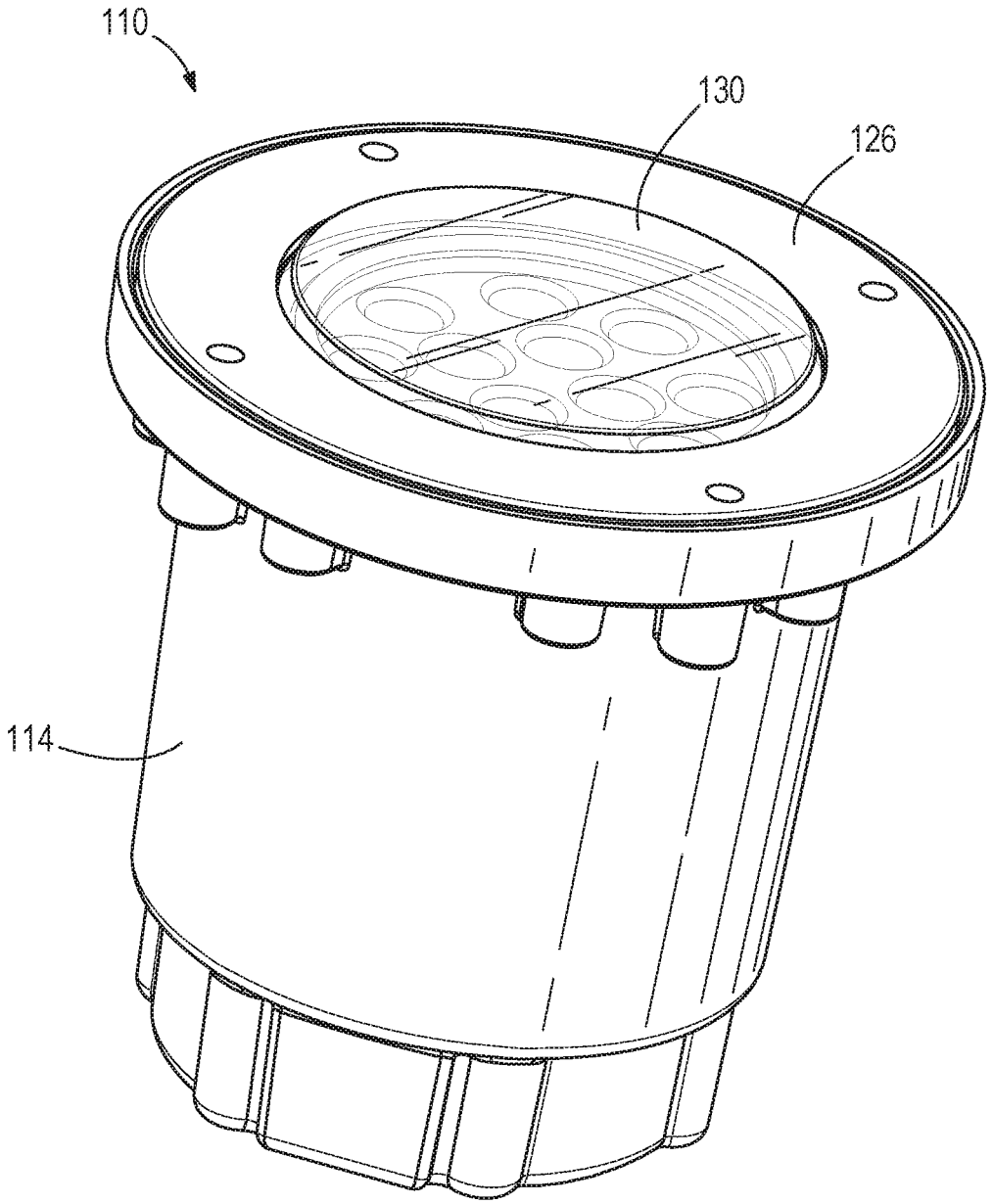
FIG. 8 is a perspective view of the lighting device of FIG. 1 including a flat frame cover portion.
Figure 9:
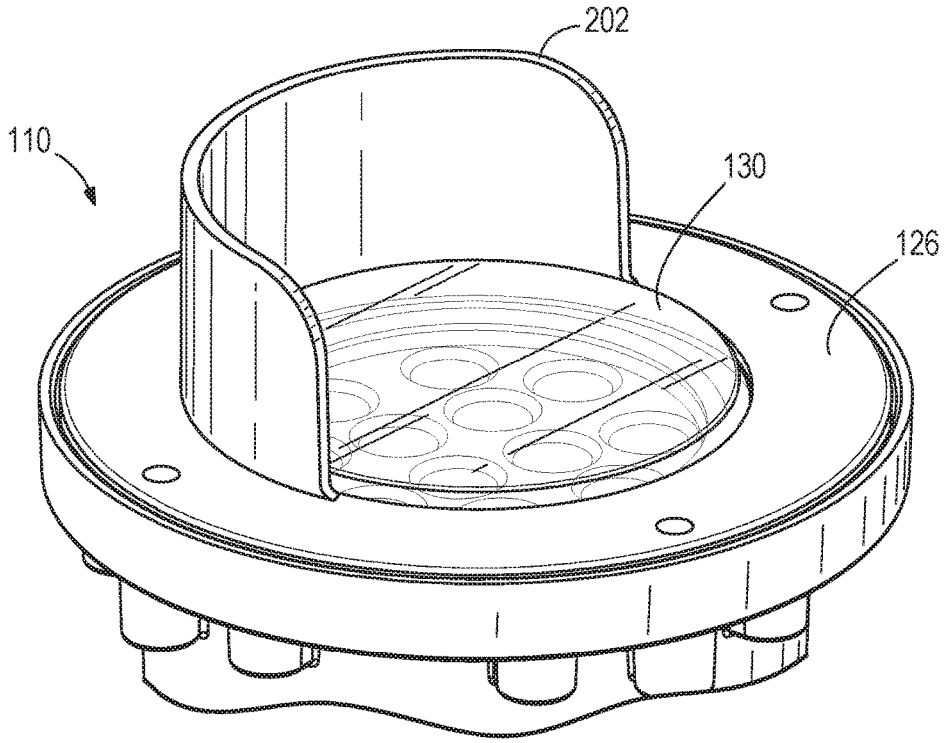
FIG. 9 is a perspective view of a cover portion including a half shield.
Figure 10:
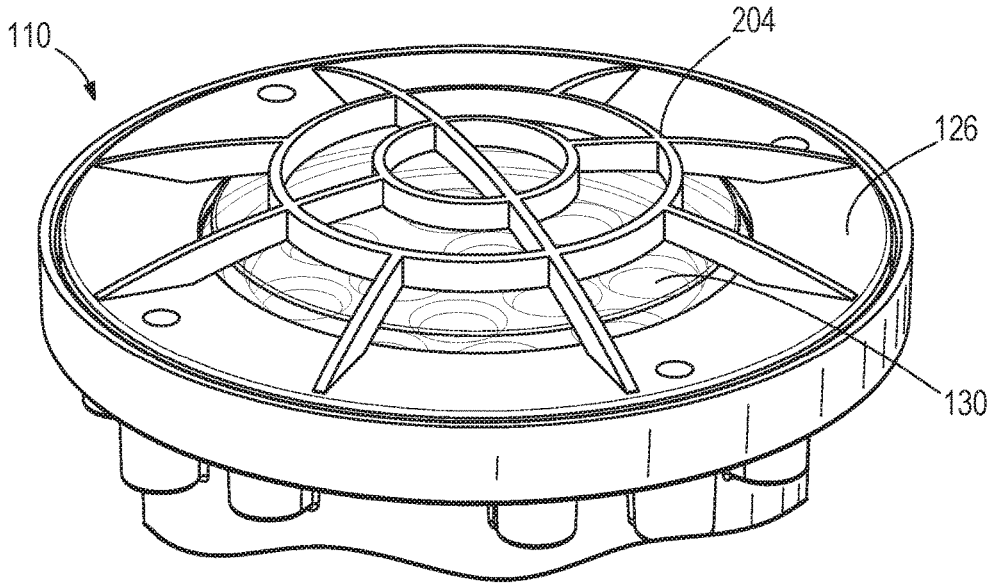
FIG. 10 is a perspective view of a cover portion including a rock guard.

The embodiment shown in FIG. 1 includes a cover portion 26 having a partially spherical shape with an angled opening and lens 30. In some embodiments, the cover portion 26 is replaced with a flat frame cover portion 126 that is substantially flush with the ground as shown in FIG. 8. In such embodiments, the light board 34 is arranged such that the center axis B is parallel with the longitudinal axis A of the housing 14. In some embodiments, the flat frame cover portion 126 may include a half shield 202 as shown in FIG. 9. In some embodiments, the flat frame cover portion 126 may include a cage or rock guard 204 to protect the lens 30 as shown in FIG. 10. In some embodiments, the flat frame cover portion 126 may be a directional marker cover that substantially covers the lens 30. Other covers can be coupled to the fixture 10 as required by the environment, use, or the desired light output.

Although, the light fixture 10 of the present application is illustrated as an in-grade light fixture it should be understood that the features illustrated and described herein are applicable to other types of light fixtures or related devices. For example, the features described herein may be used with any type of light fixture (e.g., indirect or direct light fixtures) and may be oriented in any orientation (e.g., oriented to provide up-light or down-light). In some embodiments, the lighting device may be a floodlight-type light fixture.

In general, the wirelessly controllable lighting device includes a light board, a motor, and a controller that controls various characteristics of the light output, such as the intensity, the color, and the angle of the light output, via one of a wired communication and a wireless communication device.

Although aspects have been described in detail with reference to certain preferred embodiments, variations and modifications exist within the scope and spirit of one or more independent aspects as described. Various features and advantages are set forth in the following claims.

What is claimed is:

1. An in-grade lighting device comprising:

a housing including an outer portion and an inner portion positioned at least partially within the outer portion, the outer portion including a first end and a second end opposite the first end, the first end configured to be positioned below ground, the inner portion including an opening and a lens positioned in the opening;

a light board moveably positioned in the inner portion of the housing adjacent the opening and having a plurality of light modules operable to provide a light output through the opening;

a motor operatively connected to the light board to move the light board; and a controller in electrical communication with the motor and the light board, the controller operable to receive a signal from a communication device, the controller operable to control the motor to orient the light board, an intensity of the light output of the light modules, and a color of the light output of the light modules.

2. The lighting device of claim 1, wherein the motor is operable to tilt the light board about an axis.

3. The lighting device of claim 1, wherein the communication device is a wireless communication device.

4. The lighting device of claim 1, wherein the communication device is a wired communication device electrically connected to the controller and operable to receive a signal from the wired communication device.

5. The lighting device of claim 1, wherein the color of the light output is selectable from one of a plurality of preset discrete colors stored by the communication device.

6. The lighting device of claim 1, wherein the color of the light output is selectable from a color-wheel on the communication device.

7. The lighting device of claim 1, wherein the color of the light output is determined by selecting one of, or an average of, one or more colors from an image stored on the communication device.

8. The lighting device of claim 7, wherein the image is generated with a digital camera or scanner in connection with the communication device.

9. The lighting device of claim 1, wherein the controller is operable to automatically switch the color of the light output in a predetermined sequence or algorithm.

10. The lighting device of claim 1, wherein each of the plurality of light modules includes an RGBW-type light-emitting diode having separately controllable red, green, blue, and white aspects.

11. An in-grade lighting device comprising:

a housing including an outer portion and an inner portion positioned at least partially within the outer portion, the outer portion including a first end and a second end opposite the first end, the first end configured to be positioned below ground, the inner portion including an opening and a lens positioned in the opening;

a light board positioned in the inner portion of the housing adjacent the opening and having a plurality of light modules operable to provide a light output through the opening, each of the plurality of light modules including an RGBW-type light-emitting diode having separately controllable red, green, blue, and white aspects; and a controller in electrical communication with the light board, the controller operable to receive a signal from a communication device and control a color of the light emitted by each of the light modules.

12. The lighting device of claim 11, wherein the communication device is a wireless communication device.

13. The lighting device of claim 11, wherein the communication device is a wired communication device electrically connected to the controller and operable to receive a signal from the wired communication device.

14. The lighting device of claim 11, wherein the color of the light output is selectable from one of a plurality of preset colors stored on the communication device.

15. The lighting device of claim 11, wherein the color of the light output is selectable from a color-wheel on the communication device.

16. The lighting device of claim 11, wherein the color of the light output is determined by selecting one of, or an average of, one or more colors from an image stored on the communication device.

17. The lighting device of claim 16, wherein a user may generate the image with a digital camera or scanner in connection with the communication device.

18. The lighting device of claim 11, wherein the controller is operable to automatically switch the color of the light output in a predetermined sequence or algorithm.

19. The lighting device of claim 11, further comprising a motor operatively connected to the light board to move the light board, and wherein the controller is operable to control the motor to orient the light board.

20. The lighting device of claim 11, wherein the controller is operable to control an intensity of the light output of the light module.

21. A method of operating a lighting device, comprising:

providing a housing and a light board having a plurality of light modules operable to provide a light output, the housing including an outer portion at least partially positioned below ground and an inner portion positioned at least partially within the outer portion, the inner portion supporting the light board and including a lens positioned adjacent the light board;

sending a signal indicative of a desired color from a communication device to a controller in electrical communication with the light board; and changing a color of the light output from at least some of the plurality of light modules with the controller based on the signal received from the communication device.

22. The method of claim 21, further comprising selecting the color of the light output from one of a plurality of preset colors stored on the communication device.

23. The method of claim 21, further comprising selecting the color of the light output from one of, or an average of, one or more colors from an image stored on the communication device.

24. The method of claim 23, further comprising generating the image using a camera or scanner in connection with the communication device.

* * * * *